US008998322B2

(12) United States Patent
Horiki et al.

(10) Patent No.: US 8,998,322 B2
(45) Date of Patent: Apr. 7, 2015

(54) REACTION FORCE MECHANISM FOR BACKREST OF CHAIR AND CHAIR MOUNTED WITH THE SAME

(75) Inventors: Toshiyuki Horiki, Nagano (JP); Kazuyuki Ito, Nagano (JP)

(73) Assignee: Takano Co., Ltd., Nagano (JP)

( * ) Notice: Subject to any disclaimer, the term of this patent is extended or adjusted under 35 U.S.C. 154(b) by 118 days.

(21) Appl. No.: 13/698,104

(22) PCT Filed: May 26, 2010

(86) PCT No.: PCT/JP2010/003517

§ 371 (c)(1), (2), (4) Date: Nov. 15, 2012

(87) PCT Pub. No.: WO2011/148414

PCT Pub. Date: Dec. 1, 2011

(65) Prior Publication Data

US 2013/0057037 A1 Mar. 7, 2013

(51) Int. Cl.

| | |
|---|---|
| ***A47C 7/44*** | (2006.01) |
| ***A47C 1/024*** | (2006.01) |
| ***A47C 3/00*** | (2006.01) |
| ***A47C 1/032*** | (2006.01) |

(52) U.S. Cl.

CPC ..... *A47C 1/03272* (2013.01); *A47C 1/03255* (2013.01); *A47C 1/03266* (2013.01); *A47C 1/03238* (2013.01); *A47C 1/03294* (2013.01)

(58) Field of Classification Search

CPC ..... A47C 1/032; A47C 1/03238; A47C 1/03272; A47C 1/03255; A47C 1/03294; A47C 1/03266

USPC ..... 297/316, 340, 300.1–300.8, 297/303.4–303.5

See application file for complete search history.

(56) References Cited

U.S. PATENT DOCUMENTS

| | | | | |
|---|---|---|---|---|
| 5,564,783 | A * | 10/1996 | Elzenbeck et al. | 297/300.2 |
| 6,224,160 | B1 * | 5/2001 | Takeuchi et al. | 297/440.15 |
| 6,234,573 | B1 * | 5/2001 | Roder et al. | 297/300.5 |
| 6,283,548 | B1 * | 9/2001 | Husemann | 297/300.1 |
| 7,097,249 | B2 * | 8/2006 | Igarashi et al. | 297/323 |
| 2004/0017102 | A1 * | 1/2004 | Igarashi et al. | 297/300.5 |

FOREIGN PATENT DOCUMENTS

| | | |
|---|---|---|
| JP | H0271345 U | 5/1990 |
| JP | 2000-139602 | 5/2000 |
| JP | 2005-124629 | 5/2005 |
| JP | 2008-212622 | 9/2008 |
| WO | WO 00/74531 | 12/2000 |

* cited by examiner

*Primary Examiner* — Jeanette E Chapman

(74) *Attorney, Agent, or Firm* — Notaro, Michalos & Zaccaria P.C.

(57) ABSTRACT

Reaction force mechanism for backrest of a chair has clear large space under the seat and uses a longer reaction force spring than the prior art. The mechanism includes a base member supported on a leg, a back support member coupled by a rotation shaft to the base member to recline and support the backrest, a seat support member to which the seat is mounted, a weight-dependent reaction force mechanism for moving the seat support member in a lifting direction, and a reaction force spring for applying a spring force for returning the back support member to an original position, in which the reaction force spring is disposed in a lateral orientation between the back support member and the seat support member.

7 Claims, 14 Drawing Sheets

REACTION FORCE MECHANISM FOR BACKREST OF CHAIR AND CHAIR MOUNTED WITH THE SAME

TECHNICAL FIELD

The present invention relates to a reaction force mechanism for a backrest of a chair and the chair mounted with the mechanism, the mechanism generating a force (referred to as a rocking reaction force herein) against the reclining backrest to try to push the backrest back to an original position. More specifically, the present invention relates to a reaction force mechanism for a backrest of a chair and the chair mounted with the mechanism, the mechanism using both of a weight-dependent reaction force mechanism for generating a force for pushing back the backrest by lifting a seat in relation to the reclining of the backrest of the chair and a reaction force mechanism utilizing a spring.

BACKGROUND ART

As a reaction force mechanism for a backrest and for generating a force against the backrest of a reclining chair to try to push the backrest back to an original position, there is conventionally proposed a reaction force mechanism including a weight-dependent reaction force mechanism for generating a force for pushing back the backrest by lifting a seat in relation to the reclining of the backrest as well as a reaction force mechanism utilizing a spring (Patent Literatures 1 and 2).

As shown in FIG. 19, the weight-dependent reaction force mechanism in Patent Literature 1 includes: a base 102 supported on a leg 101; a back support rod 104 to which a backrest 103 is mounted; a seat support member 106 to which a seat 105 is mounted; a shaft 107 for coupling the back support rod 104 to the base 102 so that the back support rod 104 can recline; links 108 for coupling a front portion of the seat support member 106 to the base 102; and an extension portion 110 of the back support rod 104 coupled to a back portion of the seat support member 106 by a shaft 109. When the backrest 103 reclines, the extension portion 110 of the back support rod 104 and the standing links 108 lift the seat 105.

The weight-dependent reaction force mechanism in Patent Literature 2 has the same basic concept as Patent Literature 1 in which a large reaction force is generated abruptly in an initial stage of reclining of the backrest and then the reaction force reduces. To solve this problem of the invention in Patent Literature 1, instead of the links 108, elongate holes 200 and a shaft 201 are utilized to lift a front portion of a seat support member 202 diagonally backward and upward in relation to the reclining of a back support member 203 (see FIG. 20).

Here, in each of the reaction force mechanisms for the backrests in Patent Literatures 1 and 2, a reaction force spring 111 or 204 used together with the weight-dependent reaction force mechanism is disposed vertically while sandwiched between the back support member and the base member behind a rotation shaft (a shaft which serves as a fulcrum of the weight-dependent reaction force mechanism), which serves as a rotation center of the back support member. Accordingly, the reaction force spring 111 or 204 directly receives a swing of the back support member in a vertical direction to thereby generate the reaction force.

CITATION LIST

Patent Literature

Patent Literature 1: International Publication No. WO00/74531

Patent Literature 2: Japanese Patent Application Laid-Open No. 2008-212622

SUMMARY OF INVENTION

Technical Problem

However, in each of the reaction force mechanisms for the backrests in Patent Literatures 1 and 2, because the spring for producing the reaction force is disposed vertically while sandwiched between the back support member and the base member behind the rotation shaft of the back support member and in an immediate vicinity of the rotation shaft, the reaction force spring protrudes in the vertical direction and takes up space under the seat, thereby causing disfigurement. If the reaction force spring is concealed by a cover or the like, the cover itself needs to be large, which results in a thick appearance and a heavy impression and reduces the space under the seat. Moreover, if the backrest support structure and the reaction force spring mechanism are concentrated on the back space which is originally relatively smaller and less spacious than the space under the seat and ahead of the rotation shaft of the back support member, it causes more bloating in a height direction than necessary and is against slimming down. It is also a waste not to effectively utilize the front space under the seat which is relatively spacious.

Moreover, to dispose the reaction force spring in the vertical orientation near the rotation shaft of the back support member, the reaction force spring has to be short and therefore it is necessary to use a strong and rigid spring such as an expensive spring for a metal mold, which increases cost. Because the spring is rigid, hardness in the rocking operation of the backrest is monotonous. Because the short reaction force spring has to be disposed in the immediate vicinity of the rotation shaft, an effect of adjusting an angle of the spring is hardly exerted even if the angle of the spring is changed. Moreover, the weight is applied in a compression direction of the reaction force spring in the same manner from beginning to end, which gives a user a feeling that the spring is effective even in a vicinity of a stroke end and a feeling of repulsion as if the spring pushes back. For these reasons, it is difficult to adjust the rocking hardness.

Because only the short reaction force spring can be used, it is difficult to employ, as the reaction force spring, a gas spring which has a lock mechanism and which is mechanistically difficult to miniaturize.

Therefore, it is an object of the present invention to provide a reaction force mechanism for a backrest of a chair and the chair mounted with the mechanism, the mechanism capable of simplifying an appearance under a seat and clearing large space under the seat. It is also an object of the present invention to provide a reaction force mechanism for a backrest of a chair and the chair mounted with the mechanism, the mechanism capable of using a longer reaction force spring than the same type of mechanism in the prior art.

Solution to Problem

To achieve the above objects, according to the present invention, there is provided a reaction force mechanism for a backrest of a chair, the mechanism including: a base member supported on a leg; a back support member coupled by a rotation shaft to the base member to be able to recline and support the backrest; a seat support member to which a seat is mounted; a weight-dependent reaction force mechanism for moving the seat support member in a lifting direction in relation to the reclining of the back support member; and a reaction force spring for applying a spring force for returning the back support member to an original position, in which the reaction force spring is disposed in a lateral orientation between the back support member and the base member.

Here, the spring refers to members having springy resilience in general and includes a gas spring and an elastomer, not to mention a narrowly-defined spring such as a compression coil spring. Although the reaction force spring is preferably disposed at a position of the chair ahead of the rotation shaft of the back support member, the invention is not especially limited to it. The reaction force spring may be disposed behind the rotation shaft with one end rotatably mounted to the back support member and the other end rotatably mounted to the base member, and an inclination of the reaction force spring may change as the back support member moves. Furthermore, to dispose the reaction force spring in the lateral orientation between the back support member and the base member does not necessarily mean an exactly lateral orientation but merely mean to exclude a vertical orientation in a broad sense. More properly, it aims to simplify an appearance under the seat and may include a diagonal orientation along a shape of the back support member in some cases.

According to the present invention, preferably, a compression coil spring is used as the reaction force spring, and an end portion of one of the back support member and the seat support member to which the compression coil spring is mounted includes a reaction force spring position adjusting device for rotatably bearing the reaction force spring and for giving displacement of a component in a length direction of the reaction force spring to adjust an initial compression amount of the reaction force spring.

According to the present invention, preferably, the reaction force mechanism for a backrest includes a lock mechanism for engaging the base member and the back support member with each other between the base member and the back support member, wherein the lock mechanism is formed by a fixed member mounted to the base member and a movable member mounted to the back support member, the movable member includes a stopper member for turning about a rotation shaft and having opposite ends intersecting with the fixed member, and a drive portion for turning the stopper member, and the fixed member includes, in a rotating direction of the back support member, a plurality of holes or recessed portions in which the opposite end portions of the stopper member are to be fitted.

Preferably, the lock mechanism includes a first spring for biasing the stopper member toward the holes or the recessed portions in the fixed member and a second spring disposed between the stopper member and the drive member to transmit a movement of the drive member to the stopper member, operations of the drive portion and the stopper member in relation to each other are separated from each other by expansion and contraction of the second spring and displacement of the drive member is absorbed and stored as a spring force when the stopper member cannot follow a locking operation or an unlocking operation of the drive portion, and the stopper member is turned by the spring force stored in the second spring when a frictional force with the fixed member applied on the stopper member is reduced.

The present invention is a chair mounted with the reaction force mechanism for the backrest above described.

Advantageous Effects of Invention

According to the reaction force mechanism for the backrest of the chair in the present invention, due to disposing the reaction force spring in the lateral orientation, a length of the spring is less likely to be restricted and it is possible to employ a long spring. Therefore, the same moment can be obtained with a smaller force of a spring and it is unnecessary to use a strong spring such as a spring for a metal mold, which reduces cost. Because it is possible to use the long spring, the gas spring which is mechanistically difficult to miniaturize can be used as well. If the gas spring is used, it can be used as a lock mechanism as well and it is possible to fix the backrest at any angle in the structure using the weight-dependent reaction force mechanism.

In the reaction force mechanism for the backrest in the present invention, if the reaction force spring is disposed in the lateral orientation and ahead of the rotation shaft of the back support member, the wasted space ahead of the rotation shaft can be effectively utilized and it is possible to prevent the reaction force spring from protruding in a back space to thereby achieve a simplified thin design of an entire space under the seat.

In the reaction force mechanism for the backrest in the present invention, if the reaction force spring is disposed behind the rotation shaft of the back support member, with one end rotatably mounted to the back support member and the other end rotatably mounted to the base member, and an inclination of the reaction force spring changes as the back support member moves, the spring can be compressed smoothly without buckling and it is possible to make best use of a characteristic of the spring. Because it is possible to make best use of the characteristic of the spring, even a weak spring (inexpensive spring) can be used.

Because the reaction force mechanism for the backrest in the present invention uses a compression coil spring as the reaction force spring and includes a reaction force spring position adjusting device for adjusting an initial compression amount of the spring, it is possible to adjust the initial compression amount of the reaction force spring to thereby adjust strength of the reaction force of the reaction force mechanism using the spring.

The reaction force mechanism for the backrest in the present invention further includes a lock mechanism formed by a fixed member mounted to the base member and a movable member mounted to the back support member between the base member and the back support member, the movable member includes a stopper member, for turning about a rotation shaft and having opposite ends intersecting with the fixed member, and a drive portion for turning the stopper member. The fixed member includes a plurality of holes or recessed portions, in which the opposite end portions of the stopper member are to be fitted, in a rotating direction of the back support member. Therefore, it is possible to fix the back support member at predetermined reclining angles during the reclining operation of the backrest. Consequently, usability of the chair can be further improved.

Moreover, because the stopper member can simultaneously engage its opposite ends with the fixed member by its rotational movement to achieve a locked state, it is possible to form the lock mechanism with a high degree of strength which rarely malfunctions. Because the locking at the opposite ends can be completed by the rotational movement of the single stopper member, the number of parts is small and the structure is simple. Because the stopper member is fixed at the two points, it is possible to reduce a thickness of the stopper member. Because the stopper member is provided to the movable member, it saves space. If the holes or the recessed portions are formed in the movable member, the plurality of holes or the recessed portions, in which the stopper member is to be fitted, need to be formed in the vertical direction, which increases the movable member in size and requires a large space.

Moreover, if the lock mechanism includes a first spring for constantly biasing the stopper member toward the holes or the recessed portions in the fixed member and a second spring disposed between the stopper member and the drive member to transmit a movement of the drive member to the stopper member, operations of the drive portion and the stopper member in relation to each other are separated from each other by expansion and contraction of the second spring, and displacement of the drive member is absorbed and stored as a spring force when the stopper member cannot follow a movement of the drive member. Accordingly, the stopper member can be turned by the spring force stored in the second spring when the frictional force with the fixed member and applied on the stopper member is reduced. Therefore, unless any force in the rotating direction acts on the back support member, the locked state or the unlocked state is maintained irrespective of an operating condition of the drive member.

DESCRIPTION OF EMBODIMENTS

Figure 1:
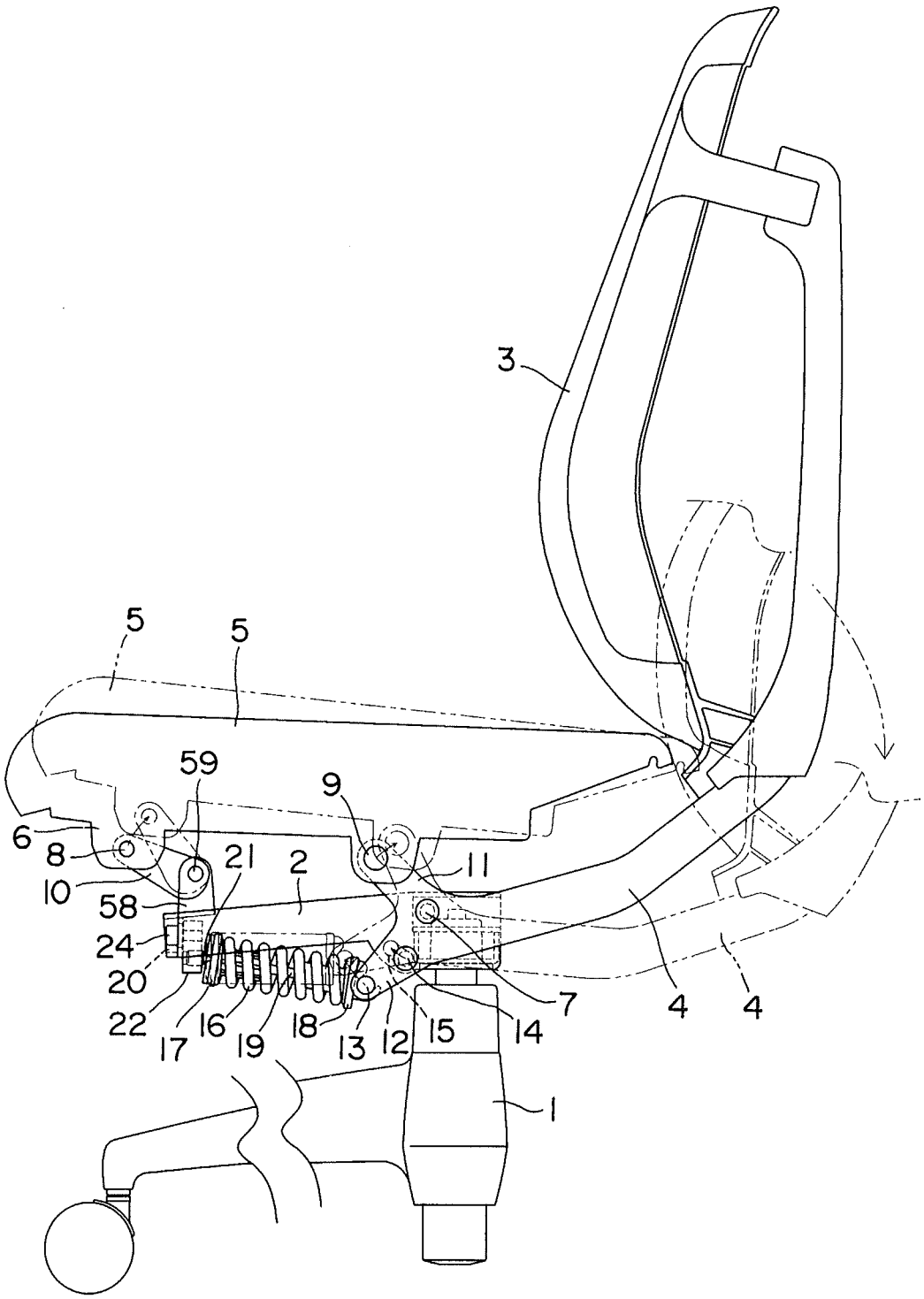
FIG. 1 is a schematic side view of a first embodiment of a chair using a reaction force mechanism according to the present invention.

A structure of the present invention will be specifically described below based on embodiments shown in the drawings.

Figure 2:
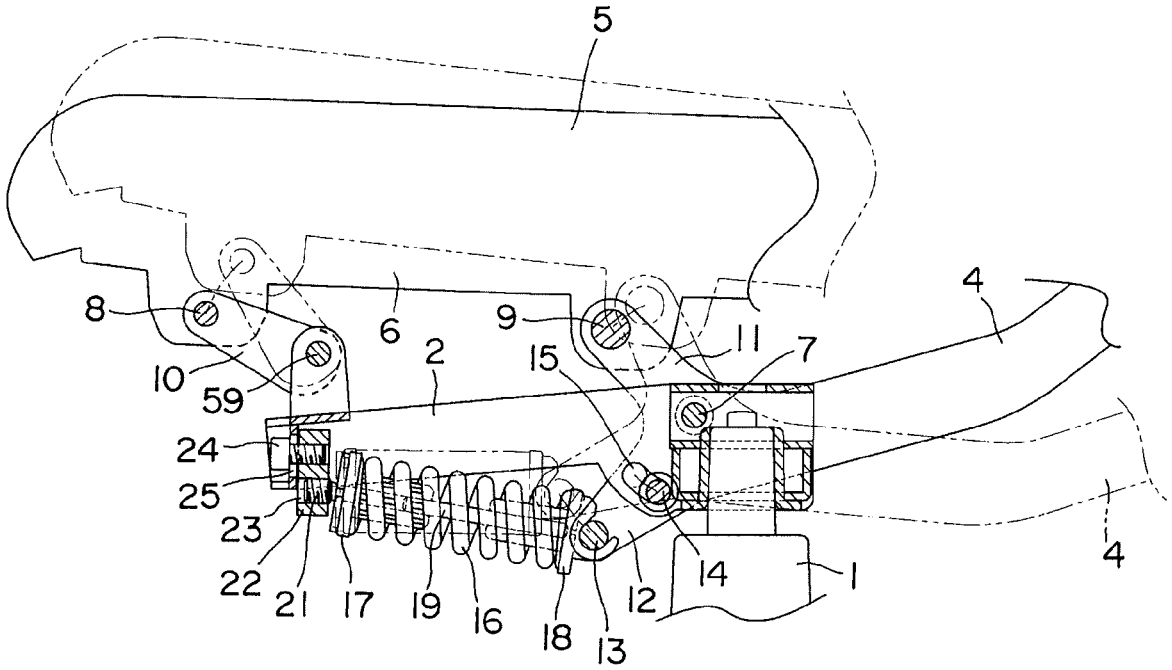
FIG. 2 is an enlarged principle diagram showing a reaction force mechanism portion of the chair.

FIGS. 1 and 2 show a first embodiment of a reaction force mechanism for a backrest of a chair according to the present invention. The reaction force mechanism for the backrest uses both of a weight-dependent reaction force mechanism for moving a seat support member 6 in a lifting direction in relation to reclining of a back support member 4 of the chair and a reaction force mechanism utilizing a reaction force spring 16 for applying a spring force for returning the back support member 4 to an original position. The reaction force spring 16 is disposed in a lateral orientation ahead of a rotation shaft 7 of the back support member 4 and between the back support member 4 and the seat support member 6.

The chair includes a leg 1, a base member 2 supported on the leg 1, the back support member 4 to which a backrest 3 is mounted, and the seat support member 6 to which a seat 5 is mounted. The back support member 4 is coupled to the base member 2 by the rotation shaft 7 to be able to recline, a front portion of the seat support member 6 is coupled to a bracket 58 of the base member 2 so as to be rotatable by coupling pins 8 and 59 with links 10 interposed therebetween, and a back portion of the seat support member 6 and lever link portions 11 extending diagonally upward and forward from the rotation shaft 7 of the back support member 4 are rotatably coupled by a coupling pin 9. Thereby, the weight-dependent reaction force mechanism is formed, in which, by the reclining operation of the back support member 4 about the rotation shaft 7, the lever link portions 11 at front portions of the back support member 4 are rotated so as to lift the back portion of the seat support member 6 diagonally backward and upward to lift the front portion of the seat support member 6 while raising the links 10 coupled to the front portion of the seat support member 6.

The back support member 4 supports the backrest 3 and functions as a lever for lifting the seat support member 6 using the backrest rotation shaft 7 as a fulcrum at the same time. The back support member 4 is divided into two branches ahead of the rotation shaft 7, the branches are formed integrally, and the branch on one side is formed as reaction force spring receiving portions 12 and the branch on the other side is formed as the lever link portions 11. In other words, the back support member is provided with the lever link portions 11 ahead and above the rotation shaft 7 and the reaction force spring receiving portions 12 for supporting an end portion of the reaction force spring 16 with a coupling pin 13 interposed therebetween ahead and below the rotation shaft, respectively. The back support member is formed to lift the seat support member 6 and compress the reaction force spring 16 to generate a reaction force when a seated person leans against the backrest 3. The back support member 4 includes a restricting pin 14 passing through rotation restricting elongate holes 15 formed in the base member 2 to define stroke ends so that the back support member can swing only in a certain range.

The base member 2 supports the back support member 4 and the seat support member 6 and is rotatably mounted on the leg 1. It suffices if the base member 2 has at least portions for supporting the back support member 4 and the seat support member 6 and rigidity, and the base member 2 is not limited to specific structure and shape. In the case of present the embodiment, the base member 2 is in a shape of a frame formed by coupling, by a front end plate 20 and a lateral plate 61, front ends of beams disposed, so as to protrude forward, to left and right of a base mounting seat 60 having a conical cylindrical bearing portion fixed by tight fitting to an upper end portion of a stay of the leg 1 and by forming, at a center, a vacant space 62 in which a lock mechanism. 31 or the lock mechanism. 31 and the reaction force spring 16 is (are) disposed.

Here, as the reaction force spring 16, a compression coil spring is used in the embodiment. As shown in FIG. 2, the reaction force spring 16 formed by the compression coil spring is disposed in a lateral orientation between a coupling pin 13 of the reaction force spring receiving portions 12 at the tip ends of the back support member 4 and the front end plate 20 at the tip end of the base member 2 with two spring mounts 17 and 18 provided to be able to move closer to and away from each other in an axial direction by a guide shaft 19. Therefore, the reaction force spring 16 is disposed in the lateral orientation between the coupling pin 13 of the reaction force spring receiving portions 12 of the back support member 4 and the front end plate 20 of the base member 2, which enables the spring to be long so as to secure a long distance from a fulcrum to a point of load, and, as a result, it is unnecessary to use a strong spring such as a spring for a metal mold. The one spring mount 17 is provided with a recessed portion in which a spherical surface of a tip end of an adjusting screw 21 is to be fitted and the other spring mount 18 is provided with a semicircular hook to be engaged with the coupling pin 13. The front end plate 20 of the base member 2 has the adjusting screw 21 having the spherical tip end, and an initial compression amount of the reaction force spring 16 is adjusted to adjust strength of the reaction force to be generated by changing an amount of protrusion of the adjusting screw 21 from the front end plate 20. The spherical surface of the tip end of the adjusting screw 21 forms a spherical seat between the recessed portion provided to the one spring mount 17 of the reaction force spring 16 and itself. Therefore, by protrusion and recession of the adjusting screw 21, an inclination of the reaction force spring 16 can be changed and an initial length of the reaction force spring 16 can be changed to adjust the reaction force. By adjusting an angle of mounting of the spring, a repulsive force at the stroke end can be reduced and it is also possible to give a springy feeling to the end (a feeling that the reaction force keeps increasing to the end).

An adjustment plate 22 having a screw hole 23 through which the adjusting screw 21 is screwed is mounted to the front endplate 20 of the base member 2 by utilizing a positioning bolt 24 and an elongate hole 25 so as to be movable in a vertical direction along the front end plate 20 to make it possible to adjust the angle of the reaction force spring 16 in the embodiment. However, the front end plate 20 and the adjustment plate 22 may be secured by welding or the like, for example, or the front end plate 20 itself may have the adjusting screw 21 if the angle of the reaction force spring 16 is fixed in mounting of the reaction force spring 16. The adjusting screw 21 protrudes from the adjustment plate 22 toward the spring mount 17 of the reaction force spring 16.

According to the reaction force mechanism for the backrest formed as described above, if the seated person leans against the backrest 3, the backrest 3 and the back support member 4 recline about the rotation shaft 7 as shown by imaginary lines while compressing the reaction force spring 16. At the same time, the lever link portions 11 at the tip ends of the back support member 4 and the links 10 try to lift the seat support member 6 and therefore the weight of the seated person applied to the seat 5 is converted into a force for pushing back the backrest 3 and acts as the reaction force on the back support member 4. As a result, the heavier the person is, the larger the force required to recline the backrest becomes. The lighter the person is, the smaller the force required to recline the backrest becomes. In other words, as a rocking reaction force in response to the force for reclining the backrest, the force corresponding to the weight of the seated person can be obtained. On the other hand, when the seated person tries to sit up, the back support member 4 is raised forward because of the action of the rocking reaction force due to the weight and expansion of the reaction force spring 16.

With this structure, the spring inclines as an inclination angle of the back support member 4 increases and therefore the generated rocking reaction force approaches a certain value. On the other hand, because the backrest reclines, the weight of the seated person applied to the backrest increases. In other words, because the spring inclines as the backrest reclines, the compression amount of the reaction force spring applied by the back support member gradually reduces and the force generated by the reaction force spring and for pushing the backrest back to the original position relatively reduces. Therefore, it is possible to obtain a reaction force characteristic in that there is no feeling of effectiveness of the spring, i.e., no feeling of repulsion for pushing back near the stroke end. In other words, it is possible to obtain the not-springy rocking reaction force which is said to give an upscale image in general.

Figure 3:
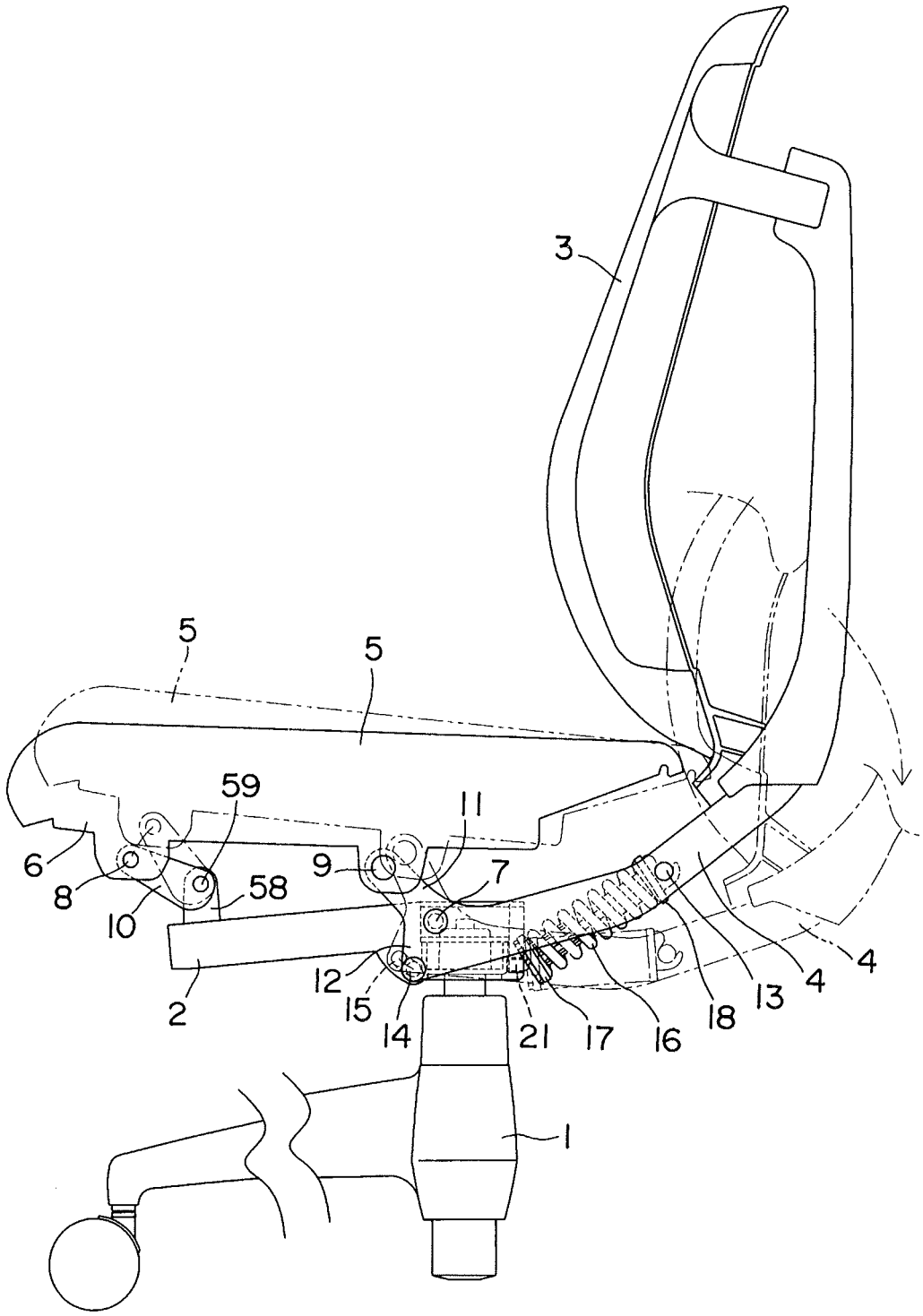
FIG. 3 is a schematic side view of a second embodiment of the chair using the reaction force mechanism according to the present invention.
Figure 4:
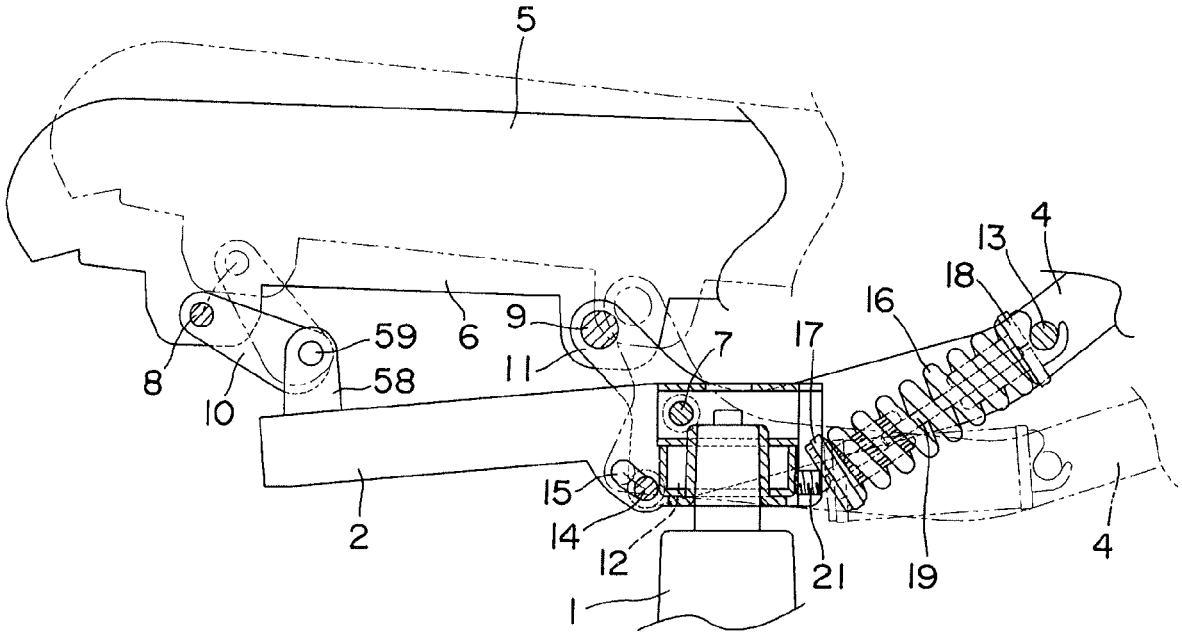
FIG. 4 is an enlarged principle diagram showing a reaction force mechanism portion of the chair according to the second embodiment.

Although the reaction force spring 16 is preferably disposed ahead of the rotation shaft 7 of the back support member 4, the invention is not especially limited to it. The reaction force spring 16 may be disposed behind the rotation shaft 7 with one end rotatably mounted to the back support member 4 and the other end rotatably mounted to the base member 2 and the inclination of the reaction force spring 16 may change as the back support member 4 moves. For example, as shown in FIGS. 3 and 4, the coupling pin 13 may be provided to the back support member 4, and the adjusting screw 21 may be provided to a back end of the base member 2. The recessed portion of the one spring mount 17 may be fitted over the spherical surface at the tip end of the adjusting screw 21 to form a rotatable bearing, the semicircular hook of the other spring mount 18 may be engaged with the coupling pin 13, and the reaction force spring 16 may be compressed by the reclining operation of the back support member 4 to generate the reaction force. In the following description and the drawings herein, the same members as those in the embodiment shown in FIGS. 1 and 2 will be provided with the same reference numerals to avoid repetition of the description of the members.

In this case, because the reaction force spring 16 is disposed between the back support member 4 and the base member 2 while substantially concealed by the back support member 4, the reaction force spring 16 protruding vertically from the shape of the back support member 4 and a large cover for covering the reaction force spring 16 are unnecessary. Accordingly, the base member under the seat and peripheral mechanisms including the back support member can be in a slim form with a simple appearance. Moreover, because there is no limitation on the length of the reaction force spring 16, it is possible to increase the length of the spring to secure the long distance from the fulcrum to the point of load and it is unnecessary to use the strong spring such as the spring for the metal mold.

Figure 5:
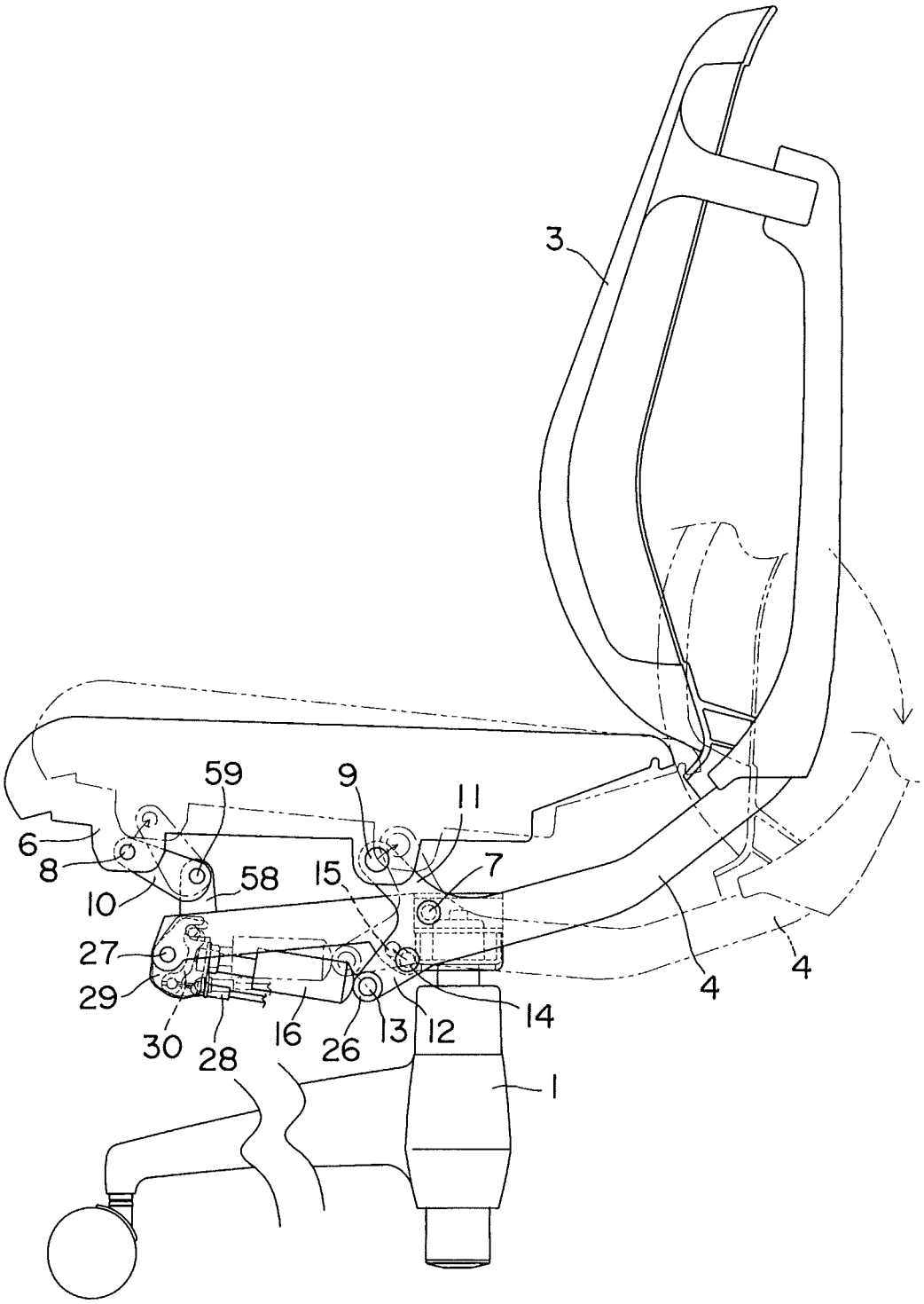
FIG. 5 is a schematic side view of a third embodiment of the chair using the reaction force mechanism according to the present invention.
Figure 6:
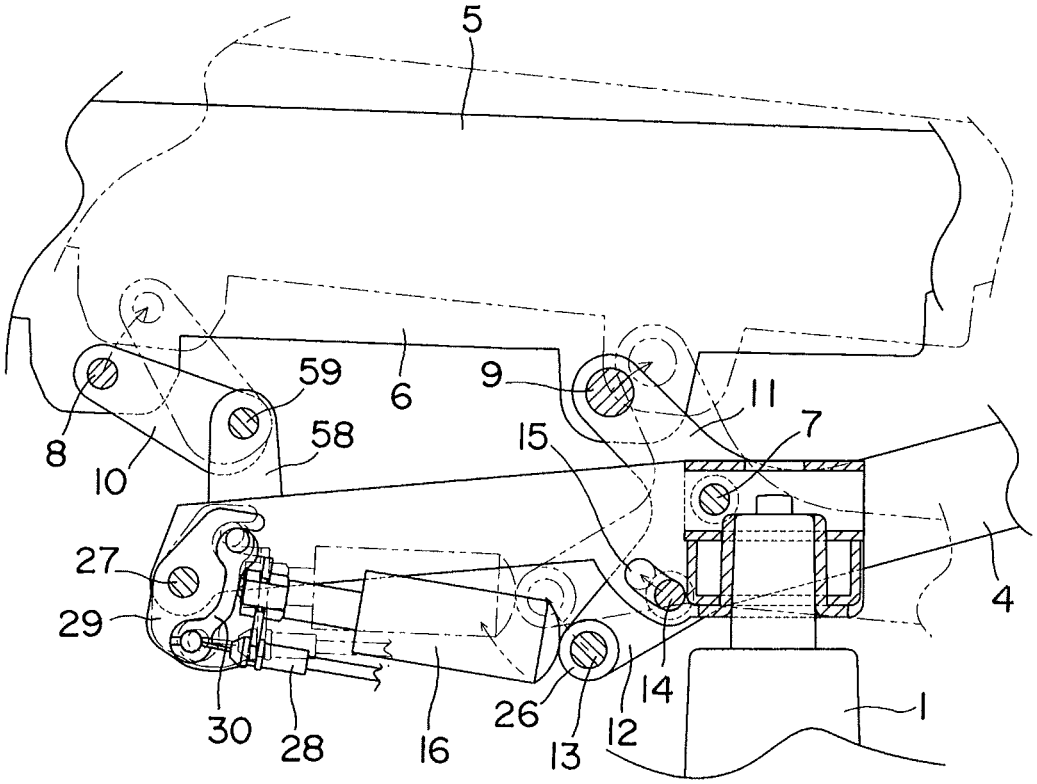
FIG. 6 is an enlarged principle diagram showing a reaction force mechanism portion of the chair according to the third embodiment.

The reaction force spring 16 is not especially limited to the above-described compression coil spring, and other members such as a gas spring and an elastomer having spring resilience may be used as well. For example, as shown in FIGS. 5 and 6, a gas spring having a lock mechanism may be employed as the reaction force spring 16 and disposed in a lateral orientation between the coupling pin 13 of the reaction force spring receiving portions 12 at the tip ends of the back support member 4 and a coupling pin 27 at the tip end of the base member 2. The gas spring 16 having the lock mechanism is mounted, so that its angle can be changed, by mounting a ring 26 at a cylinder base portion to the spring receiving portions 12 of the back support member 4 by the coupling pin 13 so that the ring 26 can rotate, and by fixing, by a nut, a rod tip end to a bracket 29 rotatably mounted to the base member 2 by the coupling pin 27. The bracket 29 has a lever 30 remotely operated by an operating wire 28, and a valve of the lock mechanism of the gas spring is operated with the lever 30. In this case, because the reaction force spring 16 itself includes a stepless lock mechanism, the movement of the back support member 4 can be fixed at any angle during the reclining operation of the back support member 4.

Figure 7:
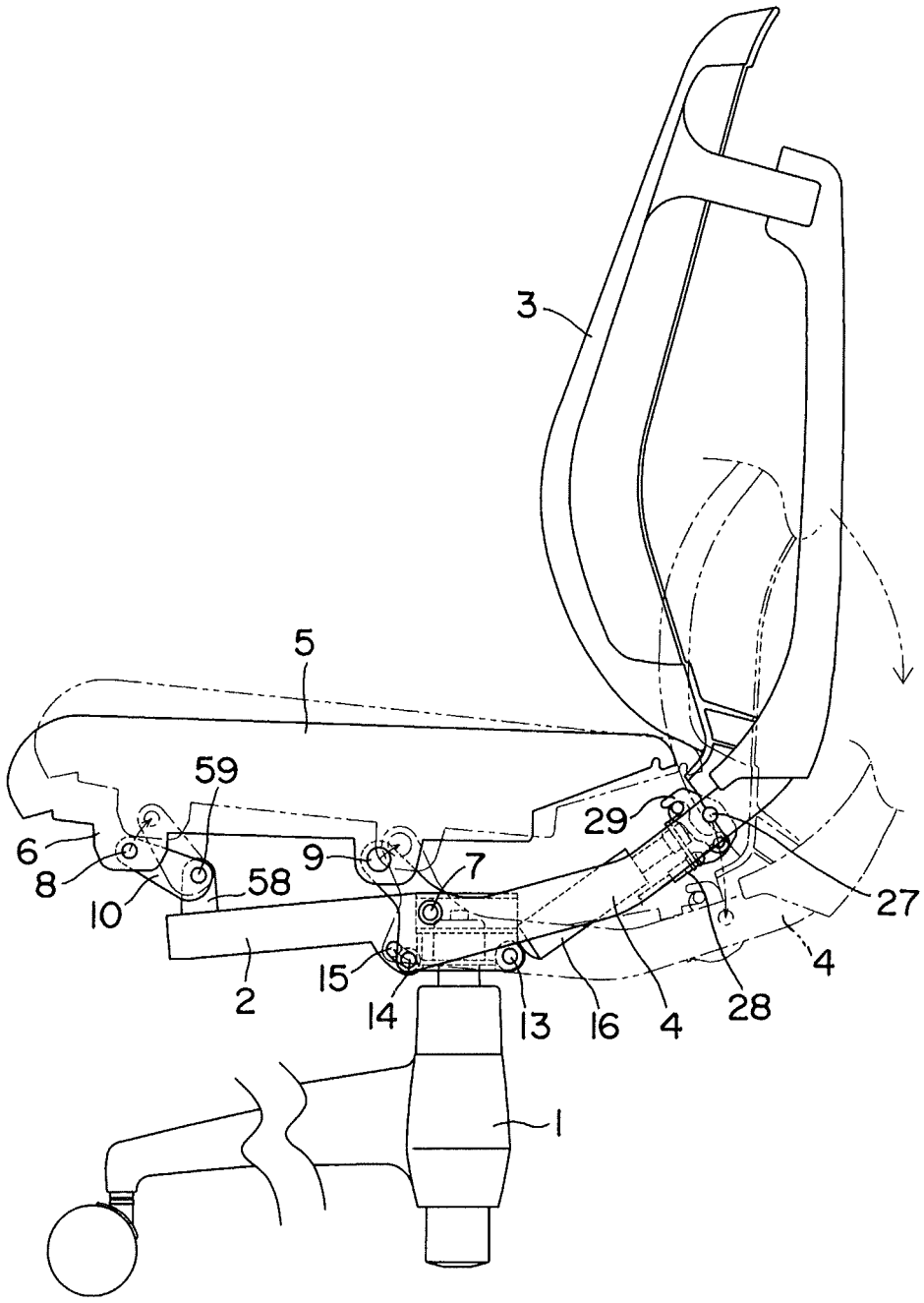
FIG. 7 is a schematic side view of a fourth embodiment of the chair using the reaction force mechanism according to the present invention.
Figure 8:
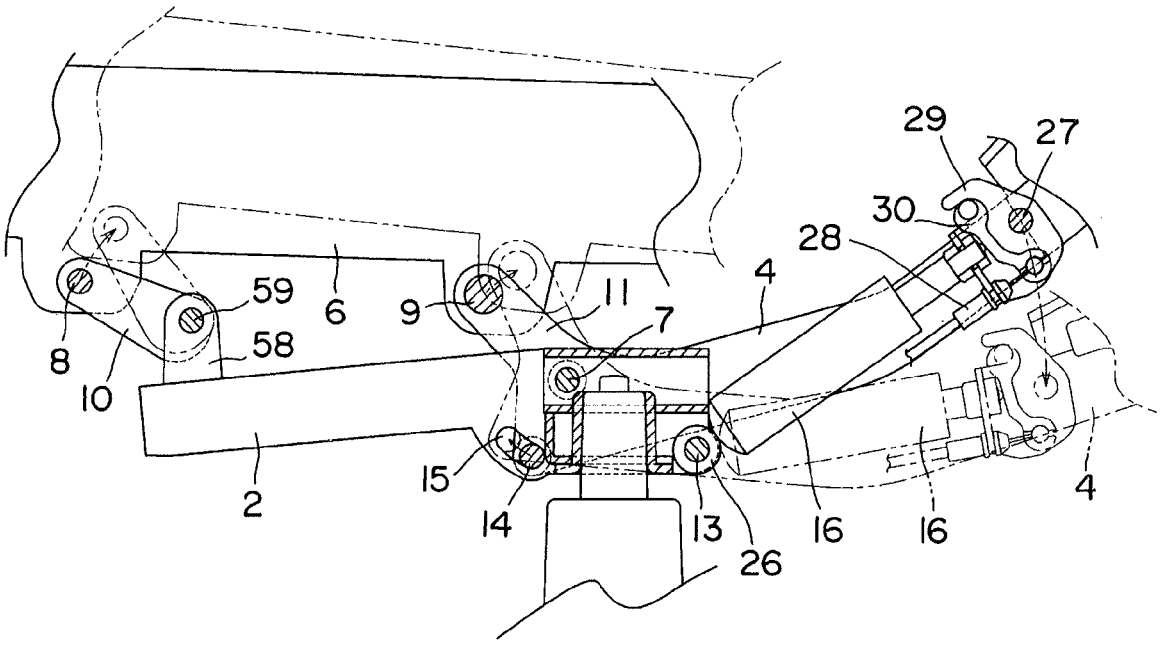
FIG. 8 is an enlarged principle diagram showing a reaction force mechanism portion of the chair according to the fourth embodiment.
Figure 9:
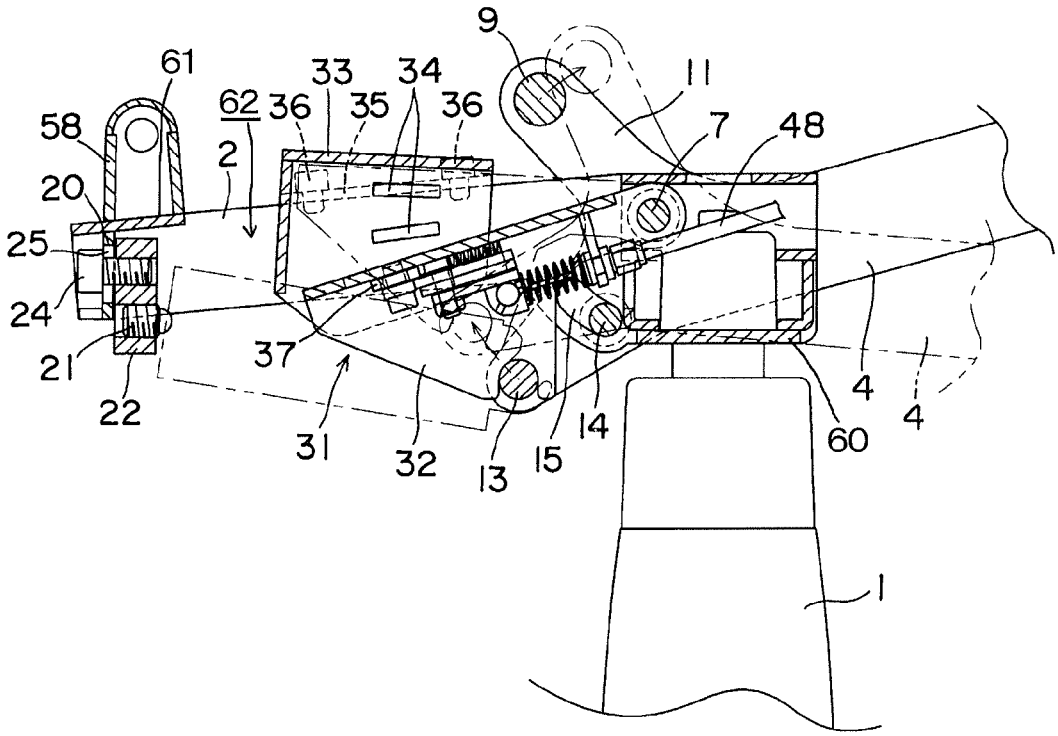
FIG. 9 is a central vertical sectional view showing an embodiment and showing a relationship between a seat receiving member and a back support member of a chair mounted with a lock mechanism.
Figure 10:
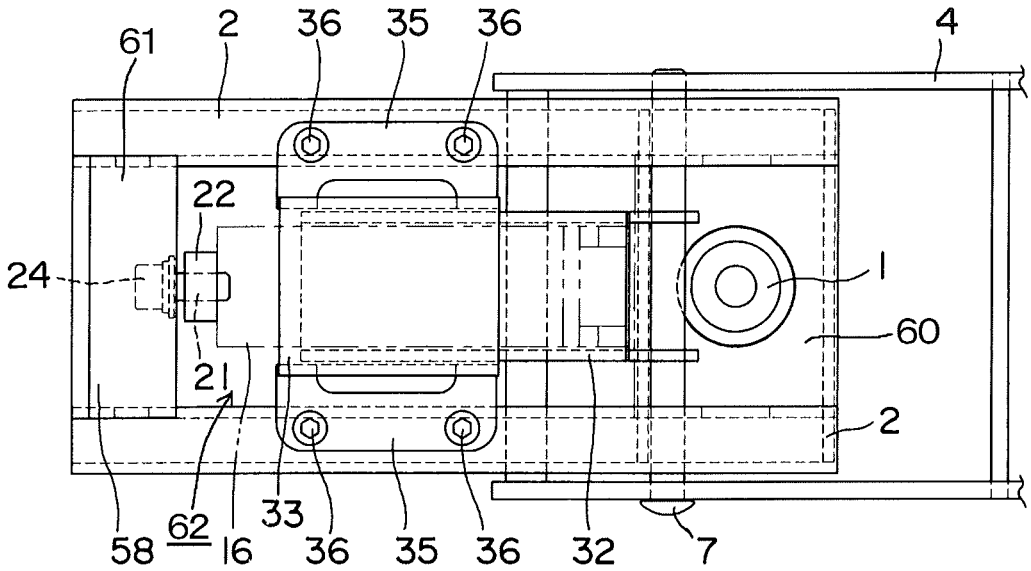
FIG. 10 is a plan view of the seat receiving member and the back support member of the chair and mounted with the lock mechanism.

The gas spring as the reaction force spring 16 and having the lock mechanism may be disposed behind the rotation shaft 7 with one end rotatably mounted to the back support member 4 and the other end rotatably mounted to the base member 2 so that an inclination of the gas spring changes as the back support member 4 moves. For example, as shown in FIGS. 7 and 8, by mounting the ring 26 at the cylinder base portion to the back end of the base member 2 by the coupling pin 13 so that the ring 26 can rotate and by fixing the rod tip end to the bracket 29 rotatably mounted to the back support member 4 by the coupling pin 27, the reaction force spring 16 may be disposed between the back support member 4 and the base member 2 while substantially concealed by the back support member 4 and the inclination of the gas spring 16 may change as the back support member 4 moves.

In the case of the reaction force mechanism for the backrest and using the compression coil spring or the elastomer as the reaction force spring 16, it is preferable to include the lock mechanism 31 for locking the back support member 4 to the base member 2. For example, the lock mechanism 31 as shown in FIGS. 9 to 16 may be provided between the base member 2 and the back support member 4 to be able to fix the backrest 3 in the reclined state. The lock mechanism 31 is formed by a fixed member 33 mounted to the base member 2 and a movable member 32 mounted to the back support member 4, the movable member 32 includes a stopper member 37 for turning about a rotation shaft 38 and having opposite ends 37*a* intersecting with the fixed member 33, and a drive portion 51 for turning the stopper member 37. The fixed member 33 includes, in its opposite sidewalls, a plurality of holes 34 or recessed portions in which the opposite end portions 37*a* of the stopper member 37 are fitted in a rotating direction of the back support member 4. The stopper member 37, the drive portion 51, an operating wire 48, and the like of the movable member 32 are supported on a ceiling portion of the movable member.

The fixed-side member 33 is formed by a groove-shaped frame 71 with its lower side open, has two left and right sidewall portions 70 which hang in the vertical direction and in each of which three holes 34 are formed radially, and includes flange portions 35 protruding outward from outsides of the opposite sidewall portions 70 to be astride the base member 2. Although the three holes 34 are formed at regular intervals on a circumference about the rotation shaft 7 in the embodiment, the number of holes and the pitch of the holes are not limited to them. The fixed-side member 33 is disposed in such a manner that the sidewall portions 70 having the holes 34 fall into the vacant space 62 at the center of the base member 2 by mounting the flange portions 35 astride the left and right beam portions of the base member 2 and fixing the flange portions 35 to the base member 2 by bolts 36 inserted through through-holes 72. The movable-side member 32 is formed by a groove-shaped base frame 69 with its lower side open and includes holes 63, which are formed in back ends of two left and right sidewall portions 67 hanging in the vertical direction and through which the rotation shaft 7 is inserted, and bearing recessed portions 64 to be engaged with a pin provided to the tip end of the back support member 4 and protruding ahead of the rotation shaft 7, e.g., the coupling pin 13 for receiving the one end of the reaction force spring 16. In each of the opposite sidewalls 67 of the movable-side member 32, a hole 50 through which each of the opposite ends 37*a* of the stopper member 37 passes is formed. The movable-side member 32 is integrated with the back support member 4 by passing the rotation shaft 7 through the holes 63 at the back end and fitting the bearing recessed portions 64 over the coupling pin 13 and operates in relation to the back support member 4. The holes 50 in the movable-side member 32 and the holes 34 in the fixed-side member 33 are preferably formed as slightly larger holes than thickness of the plate-shaped stopper member 37 to reduce backlash. The stopper member 37, the drive portion 51, the operating wire 48 and the like of the movable-side member 32, are supported on the ceiling portion 68 of the groove-shaped base frame 69 of the movable-side member 32. The stopper member 37 is operated by an operating lever or the like disposed near the seated person through the operating wire 48.

Here, the lock mechanism 31 preferably has a self-retaining function by having springs in the mechanism. As shown in FIGS. 9 to 16, for example, the self-retaining mechanism includes a first spring 44 for biasing the stopper member 37 toward the holes 34 or the recessed portions in the fixed member 33 and a second spring 45 disposed between the stopper member 37 and the drive portion 51 to transmit a movement of the drive portion 51 to the stopper member 37. When the stopper member 37 cannot follow a locking operation or an unlocking operation of the drive portion 51, operations of the drive portion 51 and the stopper member 37 in relation to each other are separated from each other by expansion and contraction of the second spring 45 and displacement of the drive portion 51 is absorbed and stored as a spring force. When a frictional force with the fixed member 33 applied on the stopper member 37 reduces, the stopper member 37 is turned by the spring force stored in the second spring 45. The self-retaining mechanism of the lock mechanism means to maintain the state of the drive portion 51 until the stopper member 37 becomes able to turn when the state of locking can be changed in the drive system by operation of the operating lever or the like (not shown) while the stopper member 37 cannot be switched. A relationship between strengths of the first spring 44 and the second spring 45 is preferably such that the first spring 44 is weaker than the second spring 45 and that the second spring contracts after the first spring 44 contracts first due to the force acting in the same direction.

The drive portion 51 is formed by a first slider 40 rotatably attached to the stopper member 37 to directly drive the stopper member 37, a second slider 41 which can slide along the first slider 40, a coupling shaft 42 passing through the first slider 40 and the second slider 41 to couple the second slider 41 to the first slider 40 so that the second slider 41 can slide, and a slider 43 disposed on an face of the first slider 41 opposite from a face on which the second slider 42 is disposed so as to prevent coming out of the coupling shaft. The second spring is housed in a guide groove 46 positioned at the center of the first slider 41 to expand and contract between a back end edge of the first slider and the slider 43. When the second slider 41 is pulled in such a direction as to separate the stopper member 37 from the holes 34 in the fixed member 33 through the operation of the operating wire 48, the second spring 45 is compressed between the slider 43 interlocked by the coupling shaft 42 and the first slider 40. Then, the second spring 45 stores the spring force for constantly biasing the stopper member 37 in such a direction as to come out of the stopper member 37 from the holes 34. The movement of the second slider 41 and the movement of the first slider 40 are transmitted to each other by the second spring 45. Therefore, if the stopper member 37 is restrained in a direction in which the stopper member 37 is to be turned, e.g., if the stopper member 37 is restrained by the frictional force or the like generated between the fixed member 33 and the movable member 32 while the tip end portions 37*a* of the stopper member 37 are fitted in the holes 34 in the fixed member 33 or if the tip ends 37*a* of the stopper member 37 biased toward the holes 34 in the movable member 32 are not aligned with the positions of the holes 34, an amount of displacement of the second slider 41 is absorbed as displacement of the second spring 45.

The second slider 42 is provided with a wire locking block 47 in which a ball of the operating wire is inserted and held, and a tip end of the wire fixed to a wire retaining bracket 49 secured to the movable member 32 by welding or the like can be held in the wire locking block 47. Between the second slider 42 and the wire retaining bracket 49 integral with the movable member 32, the first spring 44 is disposed concentrically with the operating wire 48. Therefore, if the operating wire 48 is pulled to draw the second slider 41, the first spring 44 is compressed to store a force for returning the second slider 41 to an original position.

When the stopper member 37 turns about the rotation shaft 38 disposed at the center, the opposite ends 37*a* are simultaneously fitted into the holes 34 in the left and right sidewall portions 70 of the fixed member 33 in such a manner that the opposite ends 37*a* are diagonally inserted into the holes 34. Therefore, the stopper member can be inserted more smoothly and engaged more reliably than when it is inserted to be orthogonal to the sidewall portions 70 of the fixed member. Moreover, because the stopper member 37 is engaged at its opposite ends with the fixed member 33, it is possible to increase structural strength as the lock mechanism 31. Therefore, in some cases, the stopper member 37 can be thinner than when it is cantilevered. Furthermore, because the stopper member 37 is mounted to the movable member 32, it is possible to save much more space required to have the lock mechanism than when the fixed member 33, which takes up an area in a height direction in order to form the plurality of holes 34, operates in relation to the back support member 4.

Because the lock mechanism 31 formed as described above is formed separately from the base member 2 and the back support member 4 and can be mounted to the base member 2 and the back support member 4, respectively, the lock mechanism 31 can be retrofitted if the base member has the vacant space 62 in which the lock mechanism 31 is to be fitted and spaces where the flange portions 35 of the fixed member 33 can be fixed. The base member 2 merely has screw holes through which the bolts 36 are to be inserted, and the vacant space 62 and the reaction force spring 16 is merely disposed in the lateral orientation between the front end plate 20 of the base member and coupling pin 13 of the screw receiving portions 12 of the back support member. Accordingly, because no complicated structure exists on the base member 2, the lock mechanism 31 can be retrofitted easily. It is of course possible to form the fixed member 33 integrally with the base member and the movable member 32 with the back support member 4 right from the beginning.

Figure 13:
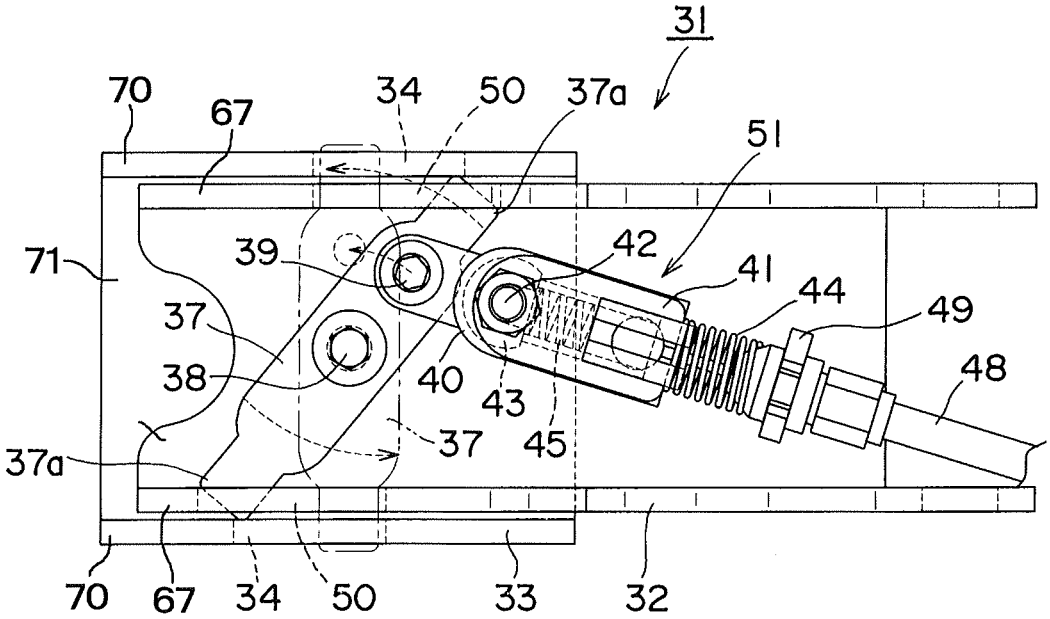
FIG. 13 is a bottom view of the lock mechanism in an unlocked state.
Figure 14:
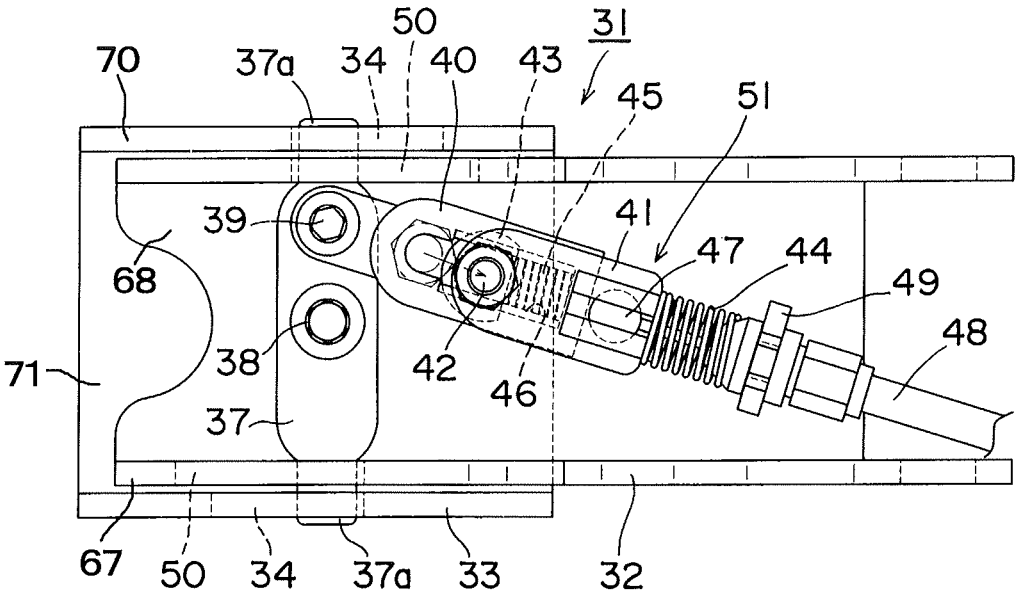
FIG. 14 is a bottom view of the lock mechanism in a locked state.
Figure 15:
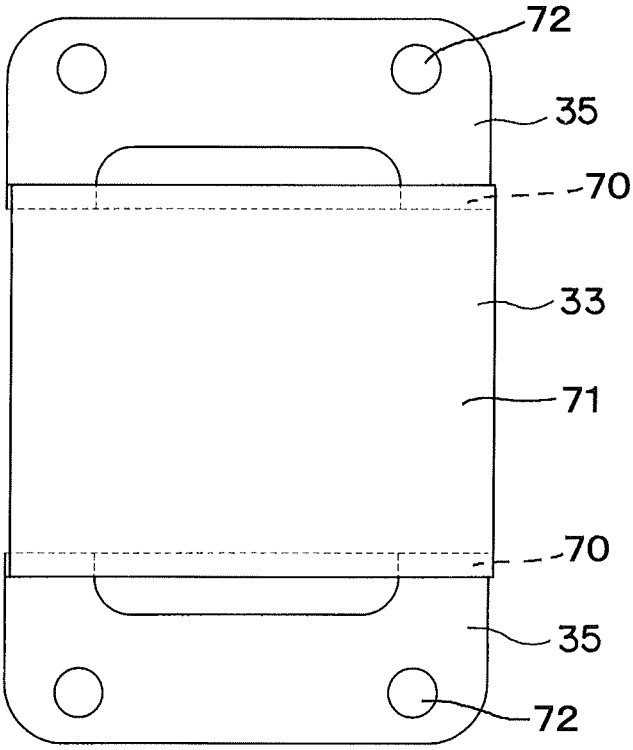
FIG. 15 is a plan view of a fixed-side member of the lock mechanism.
Figure 16:
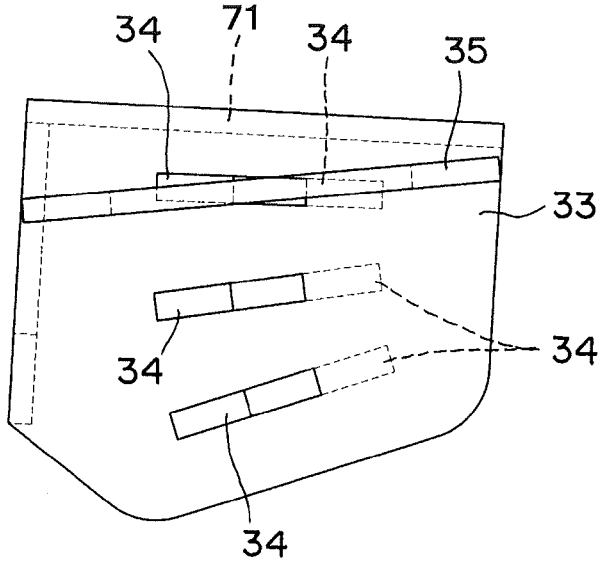
FIG. 16 is a side view of the fixed-side member.

FIG. 13 shows the unlocked state. In this unlocked state, because only the second slider 41 is pulled by the operating wire 48 and the stopper member 37 can move freely, the stopper member 37 is kept separated from the holes 34 in the fixed member 33 while the first spring 44 is compressed and the coupling shaft 42 is pushed to a front end edge of the guide groove 46 in the first slider 40 by a repulsive force of the second spring 45.

Here, if the operating wire 48 is extended to move into the locked state, the second slider 41 is pushed out toward the first slider 40 by the force of the first spring 44 and the first spring 44 is released. At this time, if the holes 34 in the movable member 32 are not aligned with the positions of the holes 34 in the fixed member 33 unlike in FIG. 13, the stopper member 37 cannot turn and therefore a coupling bolt 39, the first slider 40, and the coupling shaft 42 cannot move, either. Therefore, the second slider 41 moves forward and stops at a position where the forces of the second spring 45 and the first spring 44 come into balance with each other while compressing the second spring 45. In this state, because the second spring 45 is compressed, a force for resiliently biasing the stopper member 37 in a counterclockwise direction in the drawing is constantly applied through the coupling shaft 42 (slider 43), the first slider 40, and the coupling bolt 39 and therefore the tip ends 37*a* of the stopper member 37 are kept pushed against the sidewalls of the movable member 32. If the reaction forces of the spring 44 and the spring 45 are greatly different from each other, it is of course possible that the spring 44 comes into a compressed state, even if the first spring 44 is released and the stopper member 37 cannot turn.

Figure 11:
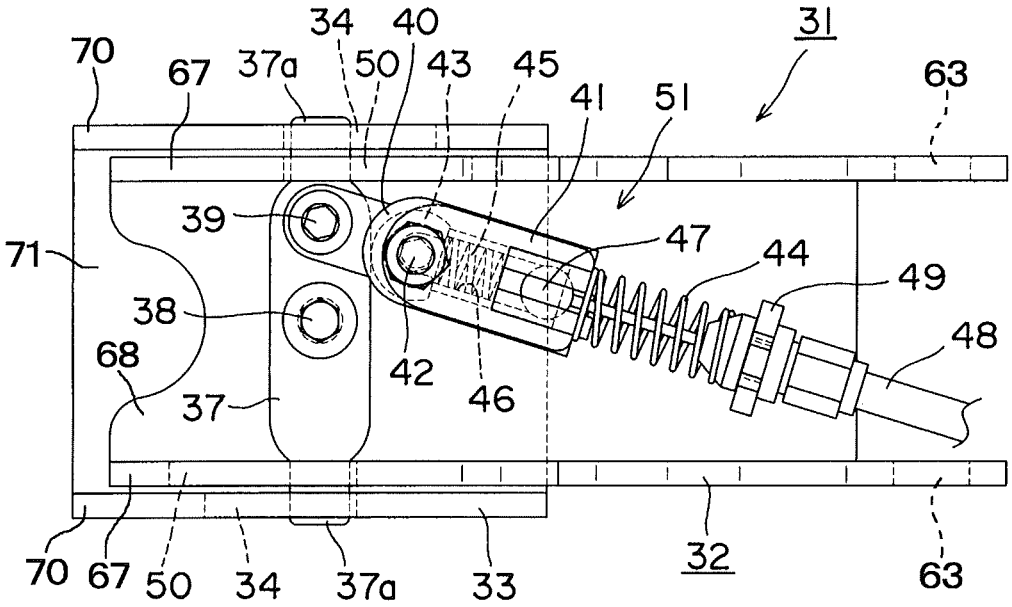
FIG. 11 is a bottom view of the lock mechanism.
Figure 12:
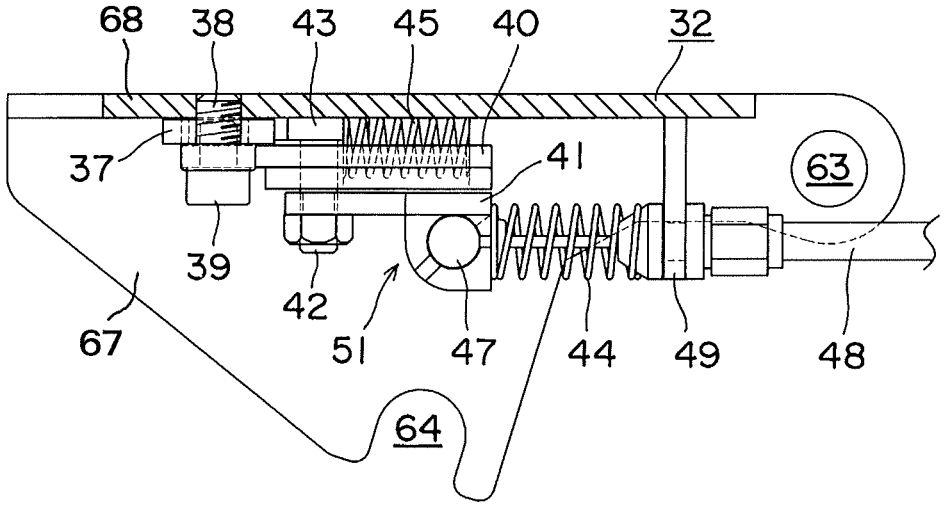
FIG. 12 is a central vertical sectional view of a movable-side member of the lock mechanism.

When the holes 34 in the movable member 32 become aligned with the positions of the stopper member 37 due to the reclining or a returning operation of the back support member 4, the tip ends 37*a* of the stopper member 37 are fitted into the holes 34 in the movable member 32 by the forces of the second spring 45 and the first spring 44 to achieve the locked state (see FIGS. 11 and 12). In this locked state, the operating wire 48 is extended and the second slider 41 is pushed by the force of the first spring 44 and the first slider 40 by the force of the second spring 45, respectively. As a result, the coupling shaft 42 of the second slider 41 moves to the front end edge of the guide groove 46 of the first slider 40 and pushes out the first slider 40 to turn the stopper member 37 and, therefore, both the first spring 44 and the second spring 45 are in expanded state.

If the operating wire 48 is pulled to try to switch from the locked state in FIGS. 11 and 12 to the unlocked state, the second slider 41 is pulled while compressing the first spring 44. At this time, if the stopper member 37 is in a freely-movable state, the first slider 40 and the stopper member 37 are caused to come out of the holes 34 in the fixed member 33 by the second spring 45 to move into the unlocked state shown in FIG. 13. However, if the stopper member 37 is restrained in the direction in which it is to be turned, e.g., if the stopper member 37 is restrained by the frictional force generated between the fixed member 33 and the movable member 32 with the tip end portions 37*a* of the stopper member 37 fitted in the holes 34 in the fixed member 33, the amount of displacement of the second slider 41 is absorbed as the displacement of the second spring 45 and the second spring 45 is compressed while the first slider 40 and the stopper member 37 are retained in the current states (see FIG. 14). In this state, though the operating wire 48 has been switched into the unlocked state, only the spring force for separating the stopper member 37 from the holes 34 in the movable member 32 is applied to the stopper member 37 which cannot come out of the holes 34. Therefore, if the back support member 4 somehow moves to reduce the above-described frictional force or the like, the first slider 40 and the stopper member 37 are immediately pulled by the force of the second spring 45 and the stopper member 37 comes out of the holes 34 in the fixed member 33 to move into the unlocked state shown in FIG. 13.

Figure 17:
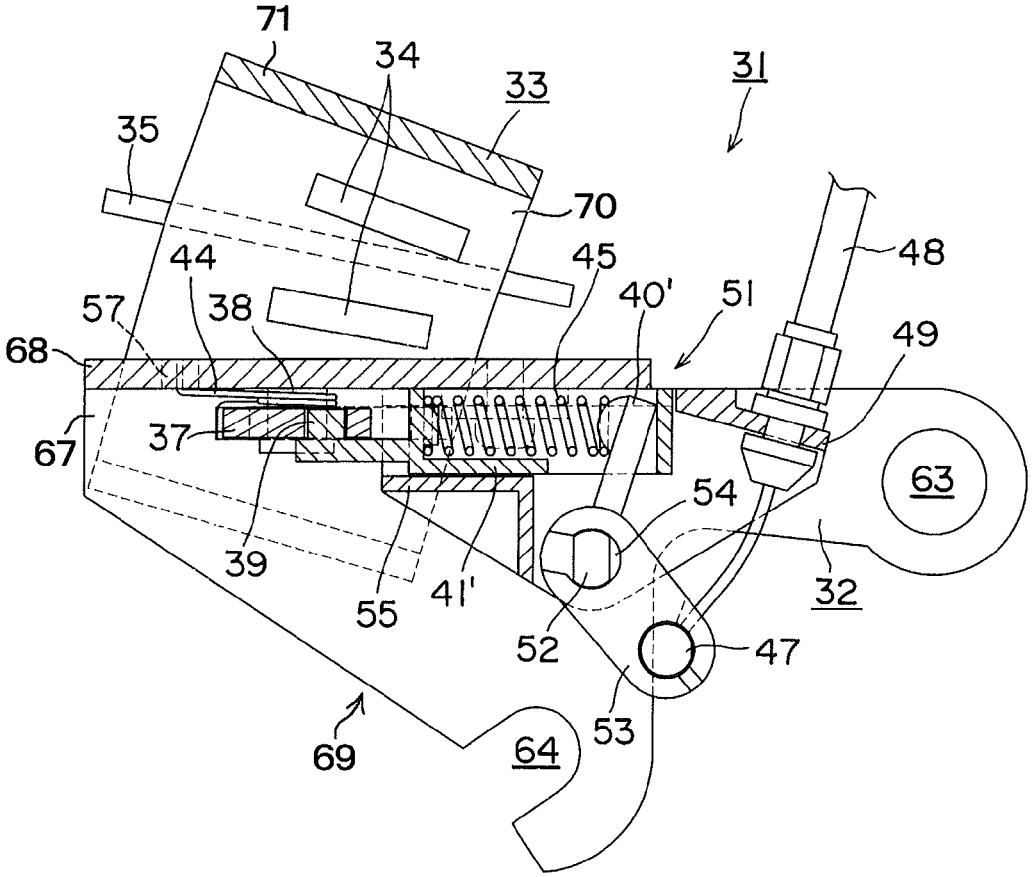
FIG. 17 is a central vertical sectional view of another embodiment of the lock mechanism.
Figure 18:
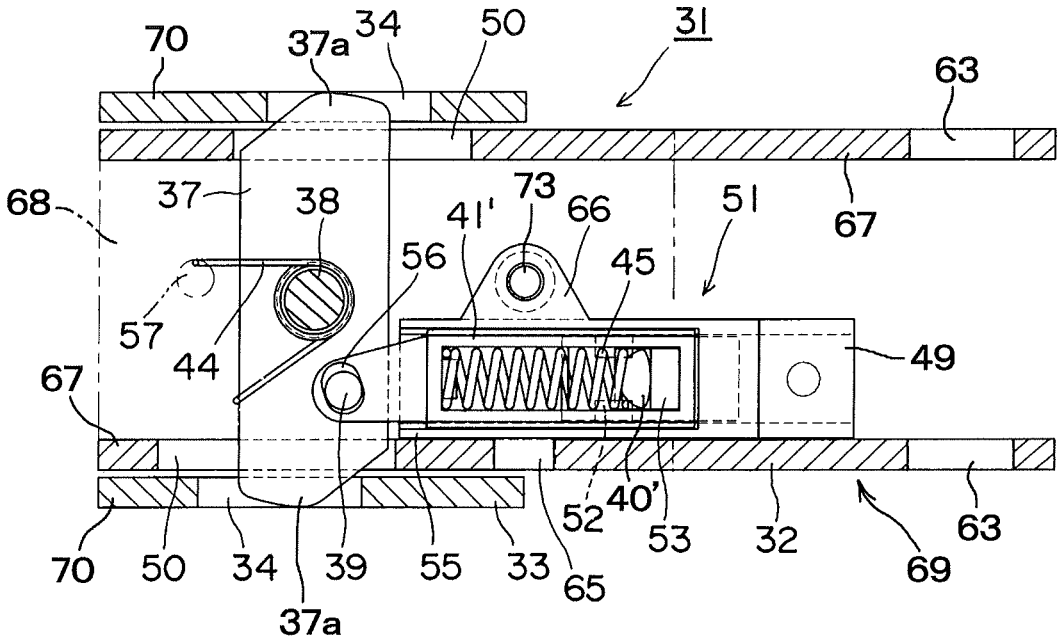
FIG. 18 is a plan view of an essential portion of the lock mechanism.
Figure 19:
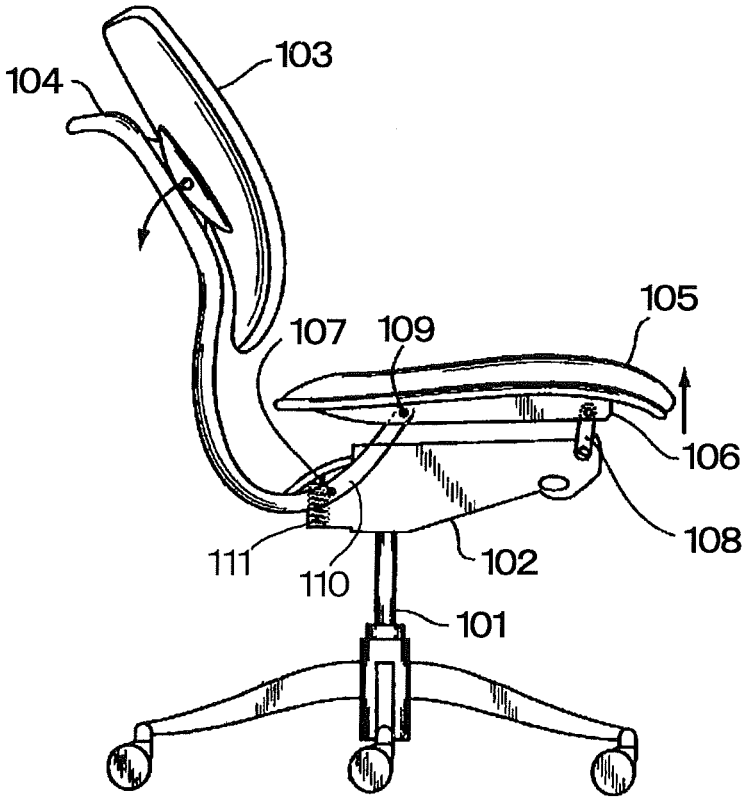
FIG. 19 is a conceptual diagram showing an example of a chair using a prior-art weight-responsive reaction force mechanism.
Figure 20:
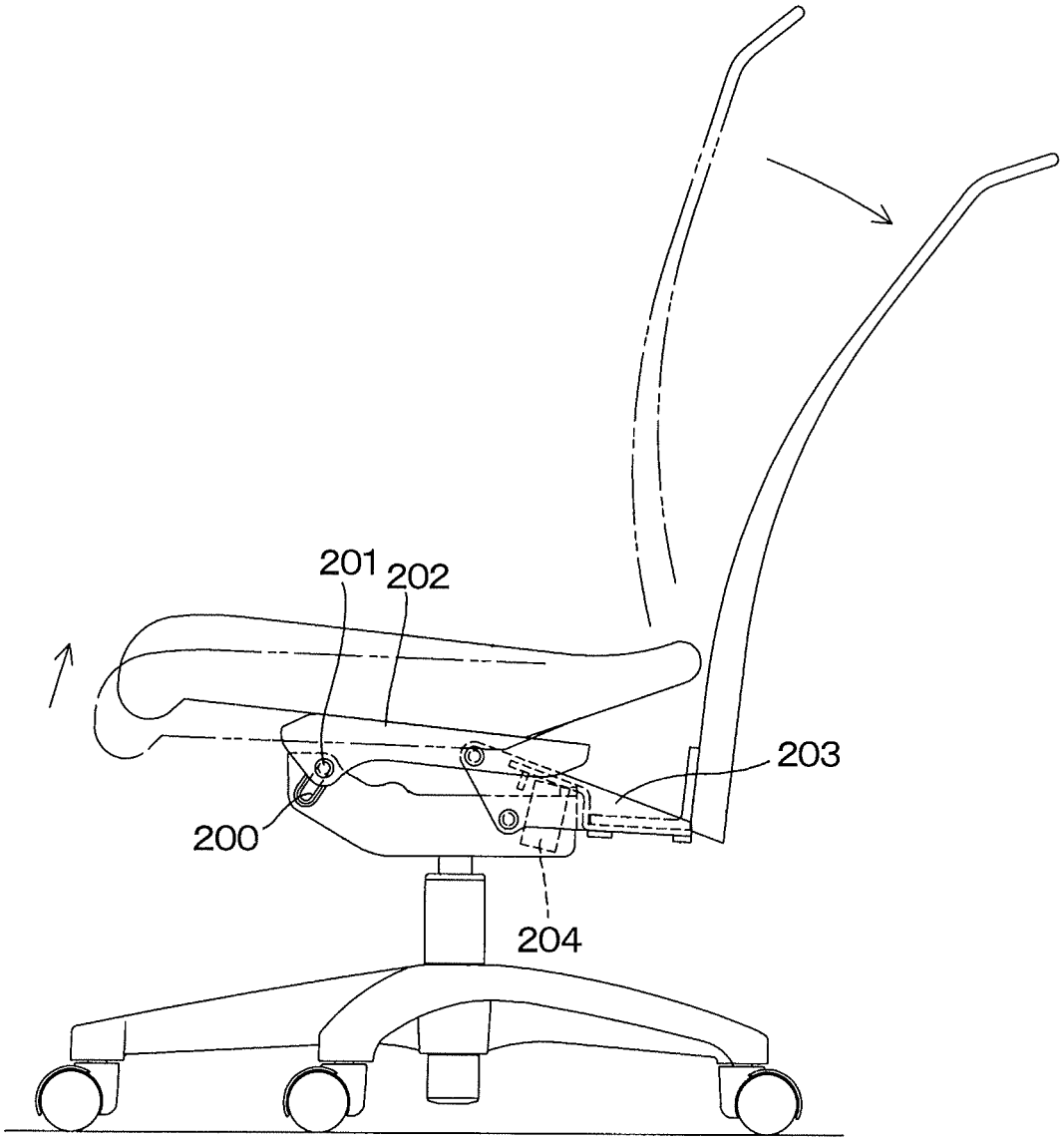
FIG. 20 is a conceptual diagram showing another example of the chair using the prior-art weight-responsive reaction force mechanism.

The lock mechanism 31 is not limited to the mechanism shown in FIGS. 9 to 16. For example, as shown in FIGS. 17 and 18, the present invention can be carried out with a lock mechanism in which the first spring 44 and the second spring 45 are disposed on opposite sides of the stopper member 37 from each other. The first spring 44 is formed by a torsion coil spring and disposed concentrically with the rotation shaft 38 which serves as a turning center of the stopper member 37, and has one end hooked on an edge of the stopper member 37 and the other end hooked in a hole 57 in the ceiling of the movable member 32 to constantly bias the stopper member 37 toward the holes 34 or the recessed portions in the fixed member 33.

On the other hand, the drive portion 51 including the second spring 45 is formed by a second slider 41' engaged only in the turning direction of the stopper member 37 through a coupling pin 39 fitted into an elongate hole 56 formed in the stopper member 37, a first slider 40' which can be driven forward and backward in the same direction as the second slider 41', a swing lever 53 for driving the first slider 40' forward and backward by the operating wire 48, and a guide 55 for supporting the second slider 41' so that the second slider 41' can move forward and backward toward the stopper member 37. The second slider 41' is in a shape of a box for housing the second spring 45 and a coupling plate having a coupling pin 39 and slipping under the stopper member 37 protrudes from a front end of the second slider 41'. A bottom portion of a back half portion of the second slider 41' is open and the first slider 40' is inserted inside to be able to move forward and backward in such a manner as to push the second spring 45. The second slider 41' is restricted at a backward stroke end by coming in contact with an edge of the guide 55. The guide 55 is for supporting the second slider 41' so that the second slider 41' can move forward and backward toward the stopper member 37 and defines a groove-shaped space having an open face only on a side facing the stopper member 37 and surrounded with peripheral three faces. The guide 55 has a protrusion 65 on one of the left and right sidewalls and a bracket 66 on the other, and is fixed to the movable member 32 by fitting the protrusion 65 into a hole formed in the sidewall of the movable member 32 and screwing the bracket 66 onto the ceiling face of the movable member 32. The swing lever 53 is supported for swinging by inserting protruding portions 52 respectively protruding from the left and right sidewalls of the guide 55 into bearing holes 54. A wire locking block 47 is provided on a tip end side of the swing lever 53 and the ball at the tip end of the wire 48 fixed to a wire retaining bracket 49 formed on the guide 55 is held in the wire locking block 47.

In the lock mechanism 31, the self-retaining function is achieved by the first spring 44 for constantly biasing the stopper member 37 to return and fit the stopper member 37 into the holes 34 in the fixed member 33 and the second spring 45 disposed between the second slider 41' for operating in relation to the stopper member 37 and the second slider 41' to be driven by the operating wire 48 to transmit the movement of the first slider 40' to the second slider 41'. A relationship between strengths of the first spring 44 and the second spring 45 is preferably such that the first spring 44 is weaker than the second spring 45 and that the second spring contracts after the first spring 44 contracts first due to the force acting in the same direction.

According to the lock mechanism 31, in the unlocked state in which the stopper member 37 has turned in a clockwise direction to come out of the holes 34 in the fixed member 33, the second slider 41' has moved leftward in FIG. 18 together with the stopper member 37 and the first spring 44 has been twisted. At this time, the first slider 40' and the swing lever 53 have turned in a counterclockwise direction in FIG. 17 because the operating wire 48 has been pulled. Then, if the operating wire is extended (released) to switch into the locked state, the swing lever 53 and the first slider 40' are released. Consequently, the stopper member 37 is turned in the counterclockwise direction by the force of the first spring 44, and the second slider 41' and the first slider 40' are also pushed back into the state in FIG. 17. At this time, if the position of the movable member 32 is not aligned with the positions of the holes 34 in the fixed member 33, the opposite end portions 37*a* of the stopper member 37 come in contact with the opposite sidewalls of the fixed member 33. As a result, the stopper member 37 cannot turn and is retained with the tip ends 37*a* of the stopper member 37 pushed against the sidewalls of the movable member 32. However, when the holes 34 in the movable member 32 become aligned with the position of the stopper member 37 due to the reclining or the returning operation of the back support member 4, the stopper member 37 is caused to rotate in the counterclockwise direction by the force of the first spring 44 and is fitted into the holes 34 in the movable member 32 to switch into the locked state. At the same time, the second slider 41' and the first slider 40' coupled by the pin 39 also return to the positions in FIG. 17.

If the operating wire 48 is pulled to switch into the unlocked state, the swing lever 53 rotates in the counterclockwise direction in FIG. 17 to move the first slider 40' forward to bias the second spring 45 in the compression direction. At this time, if the stopper member 37 is in the freely-movable state, the second slider 41' and the stopper member 37 are pushed through the second spring 45, and the stopper member 37 comes out of the holes 34 in the fixed member 33 to switch into the unlocked state. However, if the stopper member 37 is restrained by the frictional force or the like generated between the fixed member 33 and the movable member 32 while the tip end portions 37*a* of the stopper member 37 are fitted into the holes 34 in the fixed member 33, the amount of displacement of the first slider 40' is absorbed as the displacement of the second spring 45 and the second spring 45 is compressed while the second slider 41' and the stopper member 37 are retained in the current states. If the back support member 4 somehow moves to reduce the above-described frictional force or the like, the second slider 41' and the stopper member 37 are immediately pushed out of the holes 34 in the fixed member 33 by the force of the second spring 45 to switch into the unlocked state and, at the same time, the first spring 44 is twisted to store the spring force for switching the stopper member 37 into the locked state.

Although the above-described embodiments are preferred examples for carrying out the present invention, the invention is not limited to them and can be carried out while changed in various ways without departing from the gist of the invention. For example, although the example in which the front portion of the seat support member 6 is coupled to the base member 2 by the links 10 to be able to move up and down has been mainly described as the weight-dependent reaction force mechanism in the embodiments, the invention is not especially limited to it. It is needless to say that the invention can be applied when the weight-dependent reaction force mechanism in which the front portion of the seat support member is lifted diagonally backward and upward in relation to the reclining of the back support member by the elongate holes formed in the base member and the shaft of the seat support member moving in the elongate holes as disclosed in Japanese Patent Application Laid-Open No. 2008-212622. Of course, the elongate holes for lifting the front portion of the seat support member are not limited to straight holes and may be arc-shaped holes.

Although the example of the back support member formed by the left and right two levers separated to sandwich the base member 2 has been mainly described in the embodiments, the invention is not especially limited to it and the back support member having one lever disposed at a center is also possible.

REFERENCE SIGNS LIST

1 leg
2 base member
4 back support member
6 seat support member
7 rotation shaft of back support member
16 reaction force spring
21 screw having spherical tip end and forming reaction force spring position adjusting device
31 lock mechanism
32 movable member
33 fixed member
34 holes
37 stopper member
38 rotation shaft
44 first spring
45 second spring
51 drive portion

The invention claimed is:

1. A reaction force mechanism for a backrest of a chair, the mechanism comprising:

a base member supported on a leg;

a back support member coupled by a rotation shaft to the base member to be able to recline and support the backrest;

a seat support member to which a seat is mounted;

a weight-dependent reaction force mechanism for moving the seat support member in a lifting direction in relation to the reclining of the back support member; and a reaction force spring for applying a spring force for returning the back support member to an original position, wherein the reaction force spring is disposed in a lateral orientation between the back support member and the base member, wherein the weight-dependent reaction force mechanism couples a front portion of the seat support member to the base member so as to be rotatable with a link interposed therebetween, and couples rotatably a back portion of the seat support member with a lever link portion extending diagonally upward and forward from the rotation shaft, wherein the link supporting the front portion of the seat support member inclines toward a front rather than the lever link portion, wherein the lever link portion at THE front portion of the back support member rotates so as to lift the back portion of the seat support member diagonally backward and upward by the reclining operation about the rotation shaft, and wherein the front portion of the seat support member is lifted while raising the link coupled to the front portion of the seat support member.

2. The reaction force mechanism for a backrest of a chair according to claim 1, wherein the reaction force spring is disposed ahead of the rotation shaft of the back support member.

3. The reaction force mechanism for a backrest of a chair according to claim 1, wherein a compression coil spring is used as the reaction force spring, and an end portion of one of the back support member and the base member to which the compression coil spring is mounted includes a reaction force spring position adjusting device for rotatably bearing the reaction force spring and for giving displacement of a component in a length direction of the reaction force spring to adjust an initial compression amount of the reaction force spring.

4. A chair mounted with the reaction force mechanism for the backrest according to claim 1.

5. The reaction force mechanism for a backrest of a chair according to claim 1, wherein the reaction force spring is a member having spring resilience.

6. The reaction force mechanism for a backrest of a chair according to claim 2, wherein a compression coil spring is used as the reaction force spring, and an end portion of one of the back support member and the base member to which the compression coil spring is mounted includes a reaction force spring position adjusting device for rotatably bearing the reaction force spring and for giving displacement of a component in a length direction of the reaction force spring to adjust an initial compression amount of the reaction force spring.

7. A chair mounted with the reaction force mechanism for the backrest according to claim 2.

* * * * *